US008135308B2

(12) United States Patent
Doi

(10) Patent No.: US 8,135,308 B2
(45) Date of Patent: Mar. 13, 2012

(54) DETACHABLE TRANSFER UNIT USED FOR IMAGE FORMING APPARATUS AND OPERATION METHOD OF THE TRANSFER UNIT

(75) Inventor: Masahiro Doi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 786 days.

(21) Appl. No.: 12/208,927

(22) Filed: Sep. 11, 2008

(65) Prior Publication Data

US 2009/0074481 A1 Mar. 19, 2009

Related U.S. Application Data

(60) Provisional application No. 60/972,242, filed on Sep. 13, 2007.

(51) Int. Cl.
*G03G 15/08* (2006.01)

(52) U.S. Cl. ..... 399/121

(58) Field of Classification Search ..... 399/121, 399/309, 66
See application file for complete search history.

(56) References Cited

U.S. PATENT DOCUMENTS

2005/0244190 A1* 11/2005 Omata et al. ..... 399/121
2006/0062593 A1* 3/2006 Takahashi ..... 399/121

FOREIGN PATENT DOCUMENTS

JP 2004-118202 4/2004

* cited by examiner

*Primary Examiner* — David Gray
*Assistant Examiner* — Rodney Bonnette
(74) *Attorney, Agent, or Firm* — Patterson & Sheridan, LLP

(57) ABSTRACT

In an image transferring apparatus of the invention, a transfer roller which comes in press contact with a sheet sent through a sheet conveyance path and transfers a toner image formed by an image forming section onto the sheet is constructed to be capable of being pulled out from a main body frame, and after pulling from the main body frame, when it is again mounted to the main body frame, it can be easily mounted to the main body frame without receiving a reaction force caused by a pressing force to bring the transfer roller into press contact with the sheet.

14 Claims, 3 Drawing Sheets

DETACHABLE TRANSFER UNIT USED FOR IMAGE FORMING APPARATUS AND OPERATION METHOD OF THE TRANSFER UNIT

CROSS-REFERENCE TO RELATED APPLICATION

This application is based upon and claims the benefit of priority from U.S. provisional Application Ser. No. 60/972,242 filed on Sep. 13, 2007, the entire contents of which are incorporated herein by reference.

BACKGROUND OF THE INVENTION

1. Field of the Invention

The present invention relates to an image forming apparatus in which a unit including a transfer roller is constructed to be capable of being pulled out from a main body frame and a jam processing is facilitated, and an operation method of the image forming apparatus.

2. Description of the Related Art

In an image forming apparatus such as a laser printer or a digital copier, a toner image formed on an intermediate transfer medium by an image forming section provided in a main body frame is transferred onto a sheet conveyed through a sheet conveyance path. In this case, the toner image on the intermediate transfer medium is transferred onto the sheet by a transfer roller which nips the sheet as a print object and comes in press contact. As an image forming apparatus as stated above, there is one disclosed in JP-A-2004-118202, in which a duplex unit is disposed near a transfer roller. As is well known, the duplex unit is for performing duplex printing by reversing a sheet on one side of which an image is transferred and fixed and by again feeding it to a transfer roller portion.

In the image forming apparatus as stated above, for a jam processing or the like, the duplex unit is constructed to be capable of being pulled out from the main body frame. That is, when a jam occurs, the duplex unit is pulled out from the main body frame, and the space generated by the pulling is used, so that the sheet conveyance path formed in the main body frame can be easily visually confirmed from the outside. In this case, the transfer roller is attached to the side of the duplex unit, and the transfer roller is also pulled out from the main body along with the pulling of the duplex unit.

After the jam processing, the transfer roller, together with the duplex unit, is again mounted to the main body frame, however, since a force in a press contact direction applied to the transfer roller is applied as a reaction force to the mounting operation, it is difficult to perform the mounting operation. That is, the transfer roller always receives a pressing force by a spring or the like so as to come in press contact with the surface of an intermediate transfer medium across the sheet. However, when transfer is not performed, that is, when the sheet is not conveyed between the intermediate transfer medium and the transfer roller, the transfer roller is retracted to a separated position separate from the surface of the intermediate transfer medium. The retracting operation is performed such that a member for separating operation is protruded from the main body frame to push a lever member of applying the pressing force to the transfer roller.

When the foregoing transfer roller is mounted to the main body frame, transfer is not performed naturally, and accordingly, the member for separating operation provided on the side of the main body frame is in the protruded state. In this state, when the transfer roller is pushed to the side of the main body frame, the lever member of applying the pressure to the transfer roller comes in contact with the member for separating operation in the protruded state, is rotated in the direction opposite to the pressing force, and retracts the transfer roller to the separated position. That is, at the time point of completion of mounting to the main body frame, the operation is performed so that the transfer roller is retracted to the separated position.

The force to rotate the lever member against the pressing force by the contact with the member protruded from the side of the main body frame becomes the reaction force when the transfer roller is pushed to the side of the main body frame. Accordingly, it is difficult to perform the work of mounting the duplex unit including the transfer roller to the main body frame.

SUMMARY OF THE INVENTION

It is an object of the present invention to provide an image forming apparatus in which when a unit including a transfer roller, which is pulled out to the outside of a main body frame, is mounted into the main body frame, a pressing force to the transfer roller does not become a reaction force to the mounting work and the main body frame mounting can be easily performed, and an operation method of the image forming apparatus.

According to an aspect of the invention, an image transferring apparatus includes a main body frame including a sheet conveyance path to convey a sheet as a print object one by one; a unit that is constructed to be capable of being pulled out from the main body frame and includes a transfer roller to come in press contact with the sheet sent through the sheet conveyance path in a mounted state to the main body frame and to transfer a toner image formed by an image forming section onto the sheet; a holding mechanism that is provided on a side of the unit and holds the transfer roller to enable displacement between a transfer position to the sheet and a separated position separate from the transfer position; a transfer roller moving mechanism that causes the transfer roller held by the holding mechanism to be positioned at the separated position as a home position and can move the transfer roller to the transfer position; and an operation mechanism that is provided on a side of the main body frame and actuates the transfer roller moving mechanism to move the transfer roller from the separated position to the transfer position in the mounted state of the unit to the main body frame.

According to another aspect of the invention, an operation method of an image transferring apparatus includes the steps of: pulling out a transfer roller, which is attached to a unit constructed to be capable of being pulled out from a main body frame including a sheet conveyance path to convey a sheet as a print object one by one, comes in press contact with the sheet sent through the sheet conveyance path in a mounted state of the unit to the main body frame, and transfers a toner image formed by an image forming section onto the sheet, to outside of the main body unit along with pulling of the unit from the main body frame; mounting the unit to the main body frame in a state where a separated position is maintained as a home position, the transfer roller being held by a holding mechanism provided on a side of the unit to enable displacement between a transfer position to the sheet and the separated position separate from the transfer position and having the separated position as the home position by a transfer roller moving mechanism provided on the side of the unit; and moving the transfer roller from the separated position to the transfer position by actuating the transfer roller moving mechanism by an operation mechanism provided on a side of the main body frame in the mounted state of the unit to the main body frame.

DETAILED DESCRIPTION OF THE INVENTION

Hereinafter, an embodiment of the invention will be described in detail with reference to the accompanying drawings.

Figure 1:
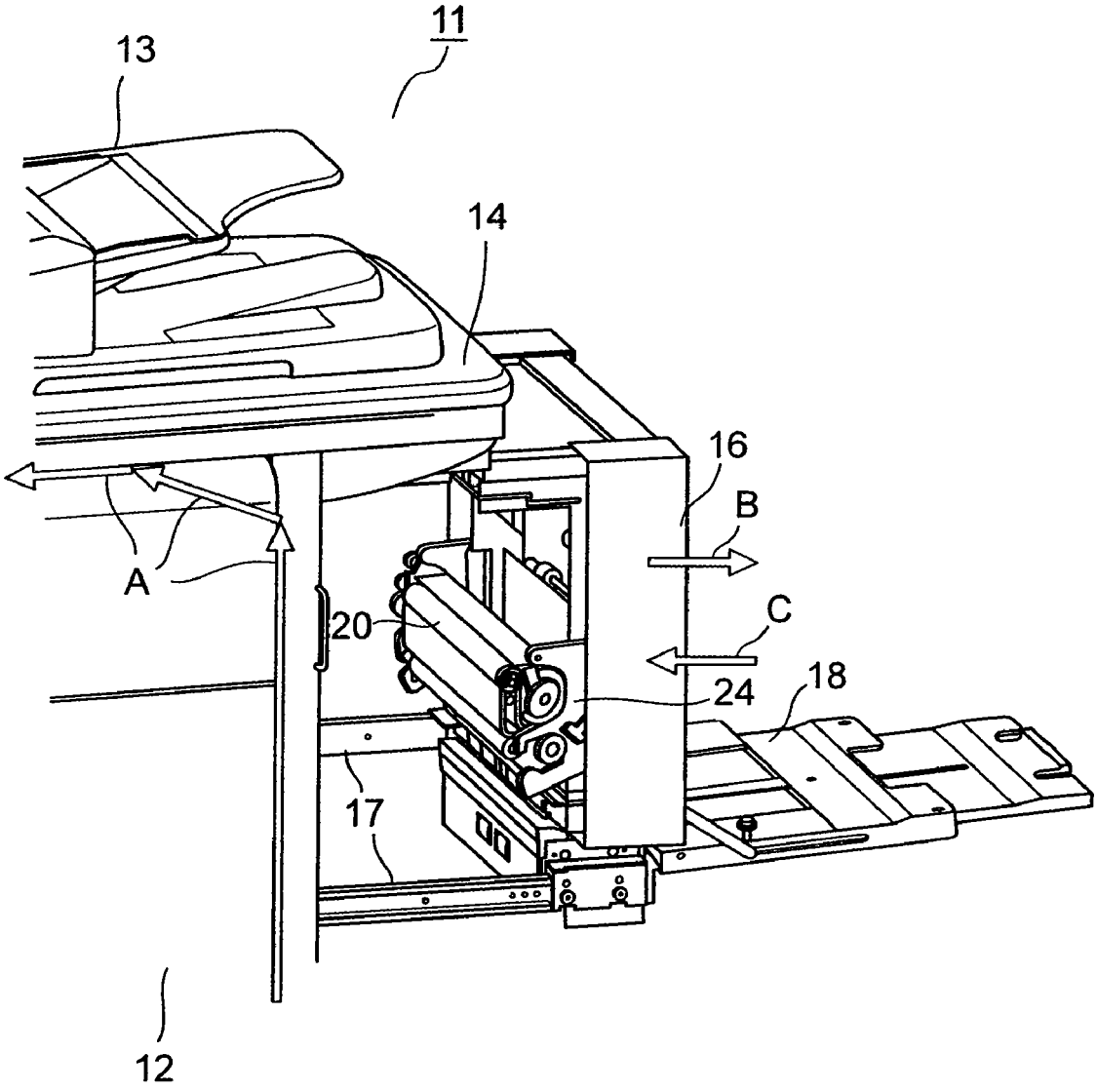
FIG. 1 is a perspective view showing an outer appearance shape of an image forming apparatus of a first embodiment of the invention.

FIG. 1 shows an outer appearance shape of a color copier 11 as an image forming apparatus of an embodiment of the invention. In FIG. 1, an auto document feeder 13 and a scanner section 14 are provided at an upper part of a main body frame 12 shaped into a case form. The auto document feeder 13 feeds an original document as a copy object to the scanner section 14 one by one. The scanner section 14 reads the original document sent from the auto document feeder 13 and generates image data.

A duplex unit 16 is attached to the right side surface, in the drawing, of the main body frame 12, and is constructed to enable parallel movement in a lateral direction by guide arms 17. The duplex unit 16 can be pulled out from the main body frame 12 by the parallel movement in the lateral direction. FIG. 1 shows a state where the duplex unit 16 is pulled out from the main body frame. Besides, a manual feed unit 18 is provided at a lower part of the duplex unit 16.

Although not shown, a sheet feeding section to feed a sheet one by one is provided at a lower part in the main body frame 12, and an image forming section to transfer a specified image to the sheet fed from the sheet feeding section is provided above that. A fixing section to fix the image transferred to the sheet by the image forming section is provided at the downstream side (upside in the drawing) of the image forming section, an intermediate unit is provided above that, and a relay unit is further provided at the side thereof.

The sheet feeding section takes out a sheet one by one from one of plural sheet feeding cassettes stacked and disposed at a lower part in the main body frame 12, and feeds it to the image forming section disposed above that. The image forming section includes an intermediate transfer medium although not shown, forms a toner image on the intermediate transfer medium based on image data read by the scanner section 14, and transfers the toner image onto the sheet sent from the sheet feeding section by a secondary transfer roller 20. The secondary transfer roller 20 is mounted in the main body frame 12 at the time of transfer, comes in press contact with the sheet nipped between itself and the not-shown intermediate transfer belt, and transfers the toner image on the intermediate transfer medium onto the sheet.

The fixing section fixes the image transferred to the sheet by a heat roller for heat fixation and a pressure roller coming in contact with the heat roller. The relay unit ejects the sheet on which the image is fixed to a specified ejection section or switches back and sends it to the intermediate unit side without ejecting it. The intermediate unit takes in the switched back sheet and guides it to an upper part of the duplex unit 16. The duplex unit 16 conveys, in a mounted state to the main body frame 12, the switched back sheet guided by the intermediate unit to a lower part in the drawing and sends it to the upstream side of the image transferring section. Thus, an image is transferred to the other side of the sheet on one side of which the image is printed, and the so-called duplex printing can be performed.

As stated above, in the main body frame 12, as indicated by an arrow A, the sheet conveyance path flowing from the lower sheet feeding section to the upper image forming section, the fixing section and the relay section is formed. The secondary transfer roller 20 is attached to the left side surface, in the drawing, of the duplex unit 16. When a check for the inside of the main body frame 12 is required, for example, when a jam occurs, as indicated by an arrow B, the secondary transfer roller, together with the duplex unit 16, is pulled out from the main body frame 12. Besides, when being mounted into the main body frame 12, as indicated by an arrow C, the secondary transfer roller, together with the duplex unit 16, is moved in parallel to the main body frame 12.

In the mounted state to the main body frame 12, the secondary transfer roller 20 is opposite to the intermediate transfer medium, and when there is no sheet at the opposite part to the intermediate transfer medium, it is retracted to a separated position separate from the intermediate transfer medium. On the other hand, when the sheet is sent to the opposite part to the intermediate transfer medium through the sheet conveyance path A, the secondary transfer roller advances to the intermediate transfer medium, nips the sheet sent to a portion between itself and the intermediate transfer medium, and transfers the toner image on the intermediate transfer medium onto the sheet.

Figure 2:
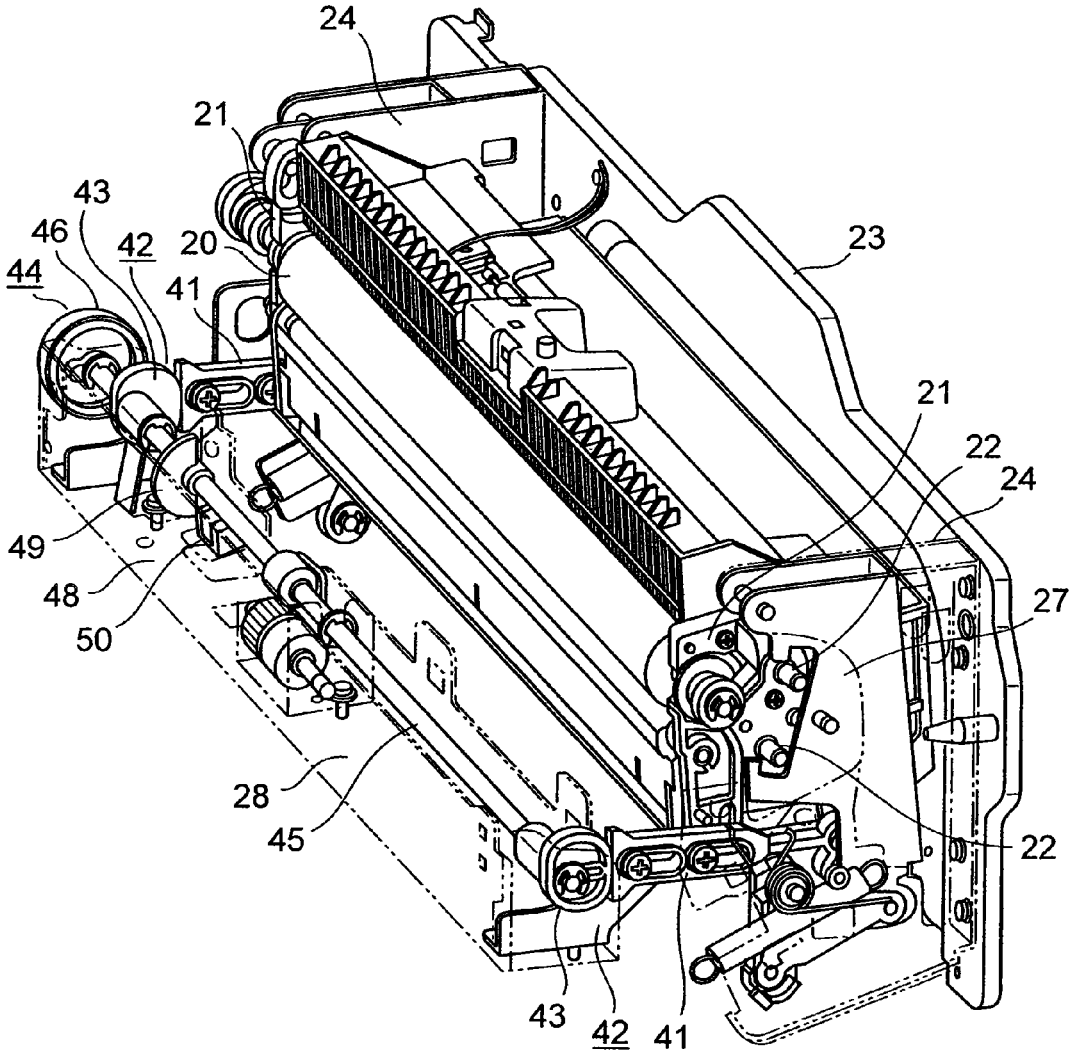
FIG. 2 is a perspective view showing a relation among a transfer roller, a moving mechanism thereof and an operation mechanism in the image transferring apparatus of the first embodiment of the invention.

FIG. 2 shows a holding structure of the secondary transfer roller 20. Both ends of the secondary transfer roller 20 are rotatably held by cases 21. The cases 21 integrally have pins 22 protruding laterally. The cases 21 are disposed in a space formed of an attachment plate 23 to the duplex unit 16 and a pair of support frames 24 provided at the right and left both sides thereof. The cases are supported by a not-shown support section to be capable of moving along the plate surfaces of the right and left pair of support frames 24 in the drawing. The secondary transfer roller 20 held by the cases 21 is displaced between the transfer position and the separated position separate from the transfer position by the movement of the cases 21. Accordingly, the case 21 and the not-shown support section to support the cases to be capable of moving them constitute a holding mechanism to hold the secondary transfer roller 20 to enable displacement between the transfer position and the separated position.

Here, the secondary transfer roller 20 is urged so that the separated position is normally a home position. The urging mechanism to the home position is not particularly illustrated, and may be constructed of a well-known spring mechanism or the like.

The right and left pair of support frames 24 have U-shaped cross sections, and a transfer roller moving mechanism 27 is provided in the inside. The transfer roller moving mechanism 27 is a mechanism to move the secondary transfer roller 20 from the separated position of the home position to the transfer position.

An operation mechanism 28 to move the secondary transfer roller 20 from the separated position to the transfer position is provided for the transfer roller moving mechanism 27. The operation mechanism 28 is constructed on the side of the main body frame 12, and in the state where the secondary transfer roller 20 is mounted in the main body frame 12, it actuates the transfer roller moving mechanism 27 and moves the secondary transfer roller from the separated position to the transfer position.

Figure 3:
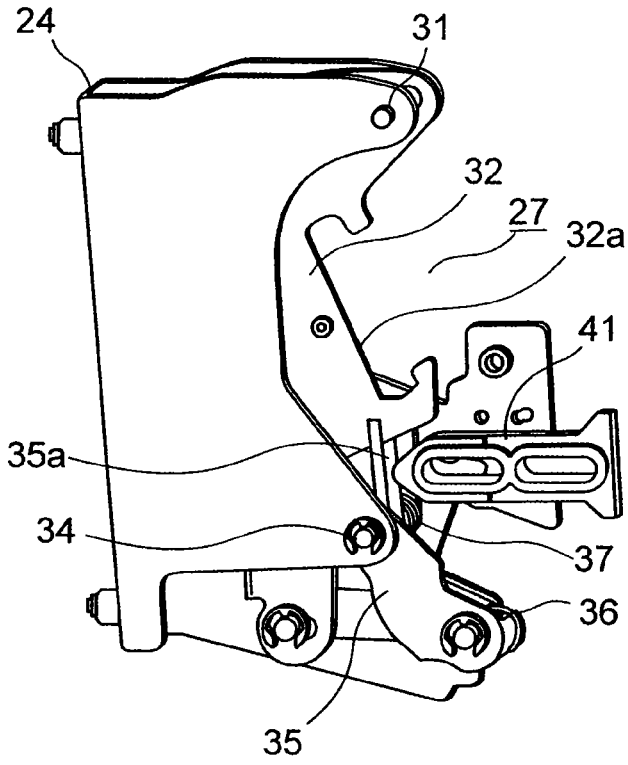
FIG. 3 is a perspective view showing the transfer roller moving mechanism in the first embodiment of the invention.
Figure 4:
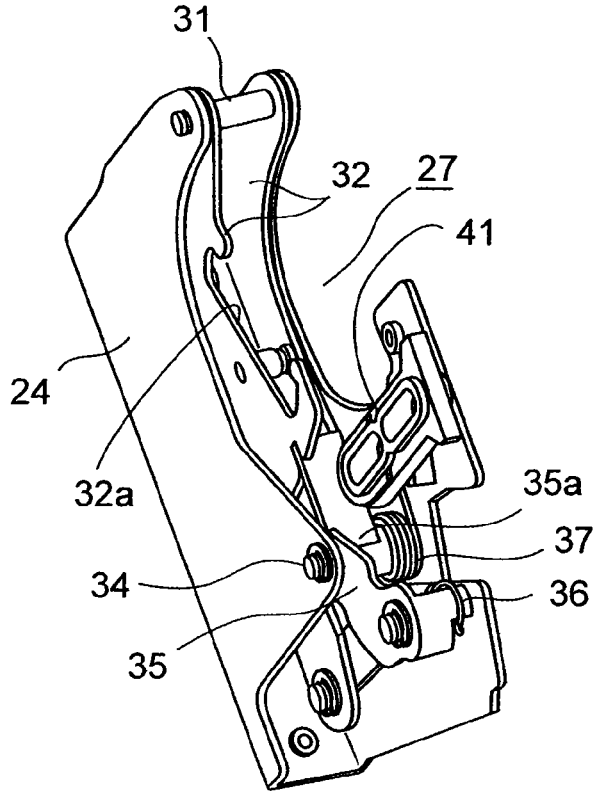
FIG. 4 is a perspective view showing, from a different angle, the transfer roller moving mechanism in the first embodiment of the invention.

FIG. 3 and FIG. 4 show the detailed structure of the secondary transfer roller moving mechanism 27. In these drawings, a first pivoted shaft 31 is provided at an upper part of the support frame 24, and an upper part of an actuating arm 32 is rotatably supported by the first pivoted shaft 31. An actuating side 32*a* is formed at an intermediate part of the actuating arm 32 in the length direction, and as shown in FIG. 2, the two pins 22 protruding laterally from the case 21 to hold the secondary transfer roller 20 are engaged with the actuating side 32*a*. The actuating arm 32 rotates counterclockwise in the drawing of FIG. 3 around the pivoted shaft 31 to move the pins 22 engaged with the actuating side 32*a* rightward in the drawing (leftward in FIG. 2), and advances the secondary transfer roller 20 to the transfer position.

A second pivoted shaft 34 is provided at a lower intermediate part of the support frame 24, and an intermediate part of a link 35 in the length direction is rotatably supported by the second pivoted shaft 34. A plane receiving section 35*a* coming in contact with a front end of a pusher 41 of the operation mechanism 28 shown in FIG. 2 and constructed on the side of the main body frame 12 is formed at an upper part of the link 35. One end of a pressure spring 36 to apply pressure at the time of transfer to the secondary transfer roller 20 is hooked to a lower part of the link 35. The other end of the pressure spring 36 is connected to a lower part of the actuating arm 32 although the details are not shown.

The link 35 always receives an acting force clockwise in the drawing of FIG. 3 by a helical spring 37, and by the leftward protrusion operation of the pusher 41, when the receiving section 35*a* comes in contact with it, the link is rotated counterclockwise in the drawing around the second pivoted shaft 34. By this rotation, the actuating arm 32 connected by the pressure spring 36 is rotated counterclockwise in the drawing around the first pivoted shaft 31. As stated above, when the actuating arm 32 is rotated counterclockwise in the drawing, the secondary transfer roller 20 is moved to the transfer position as described before, and comes in press contact with the not-shown intermediate transfer medium by the pressing force of the pressure spring 36.

That is, the transfer roller moving mechanism 27 is such that in the state where the secondary transfer roller 20 is mounted in the main body unit 12, when the pusher 41 is brought into the protruding state, the link 35 is rotated and driven by the contact with the pusher 41, the actuating arm coupled with the link 35 through the pressure spring is rotated in the same direction, and the secondary transfer roller 20 is moved to the transfer position and is brought into press contact with the intermediate transfer medium by the pressure from the pressure spring 36.

Next, the operation mechanism 28 constructed on the side of the main body frame 12 will be described with reference to FIG. 2. The operation mechanism 28 includes the pusher 41 constructed to be capable of protruding toward the transfer roller moving mechanism 27, and a drive mechanism 42 to protrude the pusher 41. The drive mechanism 42 includes a cam 43 and a rotation mechanism 44 to rotate the cam 43. The cam 43 is disposed so that its outer periphery comes in contact with the rear end of the pusher 41, and the pusher 41 is protruded by the rotation of the cam 41.

Here, two cams 43 are prepared to drive in and out the two pushers 41 provided correspondingly to the right and left of the secondary transfer roller 20, and are integrally attached to vicinities of both ends of a rotation shaft 45 constituting the rotation mechanism 44. A power transmission gear 46 is fixed to the left end, in the drawing, of the rotation shaft 45, and transmits the rotation power from a not-shown drive motor. Accordingly, the rotation shaft 45 and the cam 43 united to this are rotated and driven by the not-shown drive motor, and linearly move the corresponding pusher 41.

Besides, the rotation mechanism 44 is provided with a transfer position and separated position detection device 48 that detects a position of the pusher 41 from a rotation angle of the rotation shaft 45 and finally detects from the detected position whether the secondary transfer roller 20 is at the transfer position or the separated position. The transfer position and separated position detection device 48 includes a fan-shaped light shielding plate 49 integrally attached to the rotation shaft 45 and a sensor 50 including a light emitting element and a light receiving element disposed in a positional relation that light can be shielded by the light shielding plate 49. The light shielding plate 49 has a light shielding area corresponding to a specified rotation angle of the cam 43.

In the image forming apparatus having the structure as stated above, when a jam occurs in the sheet conveyance path A or the like in the main body frame 12, the duplex unit 16 is moved in parallel in the arrow B direction of FIG. 1 and is pulled out from the main body frame 12, and a jam processing is performed. Since the secondary transfer roller 20 is also pulled out to the outside by the pulling of the duplex unit 16, the sheet conveyance path is exposed to the outside, and the jam processing can be easily performed.

After the end of the jam processing, the duplex unit 16 is moved in the arrow C direction, and the secondary transfer roller 20 and the duplex unit 16 are mounted to specified positions in the main body frame 12. At this time, the secondary transfer roller 20 is at the separated position of the home position in the pulling state. Besides, since the sheet of the print object is not sent to the specified transfer position, the operation mechanism 28 on the side of the main body frame 12 is also in the separated operation state, and the pusher 41 is at the position retracted to the side of the main body frame 12. In this state, when the secondary transfer roller 20 and the duplex unit 16 are pushed to the side of the main body frame 12 in order to mount them to the specified positions in the main body frame 12, no reaction force is received, and accordingly, the user can easily mount them without applying a large operation force.

That is, hitherto, when the secondary transfer roller is mounted, the secondary transfer roller, which is moved to the transfer position automatically by the pulling operation, must be mounted while being moved to the separated position against the pressing force of the pressure spring, a large reaction force is received and it is difficult to perform the mounting operation.

On the other hand, in the invention, the secondary transfer roller 20 is at the separated position as the home position in the pulling state from the main body frame 12, and the pusher is also at the retracted position, and therefore, at the time of mounting to the main body frame 12, a large reaction force is not received unlike the related art, and the secondary transfer roller 20 can be easily mounted.

Thereafter, the operation mechanism 28 provided on the side of the main body frame 12 protrudes the pusher 41 in synchronization with the conveyance of the sheet, so that the secondary transfer roller 20 is advanced to the transfer position and is brought into press contact with the intermediate transfer medium through the sheet, and therefore, the toner image can be transferred to the sheet.

In the embodiment, although the secondary transfer roller 20 is attached to the duplex unit 16, the invention is not limited to this, and the secondary roller may be attached to any unit as long as the unit (including a simple cover) can be pulled out from the main body frame 12.

Besides, although the secondary transfer roller 20 to transfer the toner image formed on the intermediate transfer medium onto the sheet is exemplified as the transfer roller, the invention is not limited to the secondary transfer roller, and a transfer roller to directly transfer a toner image formed by an image forming section to a sheet may be adopted.

What is claimed is:

1. An image forming apparatus comprising:

a main body frame including a sheet conveyance path to convey a sheet as a print object one by one;

a unit that is mounted to a side surface of the main body frame to be capable of parallel movement in a lateral direction relative to the main body frame and can be pulled out from the main body frame from a mounted state by the parallel movement, and includes a transfer roller that comes into press contact with the sheet sent through the sheet conveyance path and transfers a toner image formed by an image forming section onto the sheet when the unit is in the mounted state;

a holding mechanism that is provided on a side of the unit and holds the transfer roller to enable displacement between a transfer position to the sheet and a separated position separate from the transfer position;

a transfer roller moving mechanism that causes the transfer roller held by the holding mechanism to be positioned at the separated position as a home position and can move the transfer roller to the transfer position; and an operation mechanism that is directly mounted on a side of the main body frame, and actuates the transfer roller moving mechanism to move the transfer roller from the separated position to the transfer position when the unit is in the mounted state.

2. The apparatus of claim 1, wherein the operation mechanism includes a pusher constructed to be capable of protruding to the side of the unit, and a drive mechanism to protrude the pusher, and the transfer roller moving mechanism includes a link which comes in contact with the pusher in a protruded state and is rotated and driven, and an actuating arm one end of which is rotatably supported, the other end of which is coupled to the link through a pressure spring, and which interlocks with the rotation of the link through the pressure spring and moves the transfer roller to the transfer position.

3. The apparatus of claim 2, wherein the drive mechanism includes a cam whose outer periphery comes in contact with a rear end of the pusher, and a rotation mechanism to rotate the cam, and the pusher is protruded by rotation of the cam.

4. The apparatus of claim 3, wherein the drive mechanism includes a transfer position and separated position detection device to detect a rotation angle of the cam and to detect from the rotation angle whether the transfer roller is at the transfer position or the separated position.

5. The apparatus of claim 4, wherein the transfer position and separated position detection device includes a light shielding plate integrally attached to a rotation shaft of the cam and having an area corresponding to a specified rotation angle, and a sensor including a light emitting element and a light receiving element disposed in a positional relation that light can be shielded by the light shielding plate.

6. The apparatus of claim 1, wherein the unit is a duplex unit that again conveys a sheet to one side of which an image is transferred by the transfer roller to the sheet conveyance path at an upstream side of the transfer roller to transfer an image to the opposite side thereof.

7. The apparatus of claim 1, wherein the transfer roller is a secondary transfer roller to transfer a toner image formed on an intermediate transfer medium by the image forming section onto the sheet conveyed through the sheet conveyance path.

8. An operation method of an image forming apparatus, comprising the steps of:

pulling out a transfer roller, which is attached to a unit that is mounted to a side surface of the main body frame to be capable of parallel movement in a lateral direction relative to a main body frame and can be pulled out from the main body frame from a mounted state by the parallel movement, and which comes into press contact with a sheet sent through a sheet conveyance path in the main body frame and transfers a toner image formed by an image forming section onto the sheet when the unit is in the mounted state, to outside of the main body frame by pulling the unit from the main body frame by the parallel movement;

mounting the unit to the main body frame in a state where a separated position is maintained as a home position, the transfer roller being held by a holding mechanism provided on a side of the unit to enable displacement between a transfer position to the sheet and the separated position separate from the transfer position and having the separated position as the home position by a transfer roller moving mechanism provided on the side of the unit; and moving the transfer roller from the separated position to the transfer position by actuating the transfer roller moving mechanism by an operation mechanism directly mounted on a side of the main body frame when the unit is in the mounted state.

9. The method of claim 8, wherein the operation mechanism protrudes a pusher, which is constructed to be capable of protruding to the side of the unit, by a drive mechanism, and the transfer roller moving mechanism includes a link which comes in contact with the pusher in a protruded state and is rotated and driven, and an actuating arm one end of which is rotatably supported, and the other end of which is coupled to the link through a pressure spring, the actuating arm is interlocked with the rotation of the link through the pressure spring, and the transfer roller is moved to the transfer position.

10. The method of claim 9, wherein the drive mechanism includes a cam whose outer periphery comes in contact with a rear end of the pusher, and a rotation mechanism to rotate the cam, and the pusher is protruded by rotation of the cam.

11. The method of claim 10, wherein a transfer position and separated position detection device of the drive mechanism detects a rotation angle of the cam and detects from the rotation angle whether the transfer roller is at the transfer position or the separated position.

12. The method of claim 11, wherein the transfer position and separated position detection device rotates a light shielding plate having an area corresponding to a specified rotation angle of a rotation shaft of the cam between a light emitting element and a light receiving element of a sensor along with the rotation of the cam, and detects the protruded state of the pusher by existence of light shielding.

13. The method of claim 8, wherein the unit is a duplex unit that again conveys a sheet to one side of which an image is transferred by the transfer roller to the sheet conveyance path at an upstream side of the transfer roller to transfer an image to the opposite side thereof.

14. The method of claim 8, wherein the transfer roller is a secondary transfer roller to transfer a toner image formed on an intermediate transfer medium by the image forming section onto the sheet conveyed through the sheet conveyance path.

* * * * *